US010614688B1

(12) United States Patent
Pachikov et al.

(10) Patent No.: US 10,614,688 B1
(45) Date of Patent: Apr. 7, 2020

(54) DETECTING AND IDENTIFYING ACTIVITIES AND EVENTS WITHIN A PROPERTY'S SECURITY PERIMETER USING A CONFIGURABLE NETWORK OF VIBRATION AND MOTION SENSORS

(71) Applicant: Sunflower Labs Inc., San Carlos, CA (US)

(72) Inventors: Alexander S. Pachikov, San Carlos, CA (US); Christian Eheim, Fällanden (CH); Nicolas de Palezieux, Zurich (CH)

(73) Assignee: Sunflower Labs Inc., Palo Alto, CA (US)

( * ) Notice: Subject to any disclaimer, the term of this patent is extended or adjusted under 35 U.S.C. 154(b) by 0 days.

(21) Appl. No.: 15/920,750

(22) Filed: Mar. 14, 2018

Related U.S. Application Data

(63) Continuation-in-part of application No. 15/895,606, filed on Feb. 13, 2018.

(60) Provisional application No. 62/474,274, filed on Mar. 21, 2017, provisional application No. 62/465,439, filed on Mar. 1, 2017.

(51) Int. Cl.
*G08B 13/22* (2006.01)

(52) U.S. Cl.
CPC ..... *G08B 13/22* (2013.01)

(58) Field of Classification Search
None
See application file for complete search history.

(56) References Cited

U.S. PATENT DOCUMENTS

| | | | | |
|---|---|---|---|---|
| 8,140,226 | B2 * | 3/2012 | Wagner | B60R 1/00 180/274 |
| 8,779,921 | B1 * | 7/2014 | Curtiss | G08B 25/009 340/506 |
| 10,223,753 | B1 * | 3/2019 | Marlow | B64C 39/024 |
| 10,319,099 | B2 * | 6/2019 | Tsunashima | G06K 9/00335 |
| 2009/0009599 | A1 * | 1/2009 | Lee | G08B 13/19608 348/143 |

* cited by examiner

*Primary Examiner* — Jayanti K Patel
*Assistant Examiner* — Shadan E Haghani
(74) *Attorney, Agent, or Firm* — Muirhead and Saturnelli, LLC

(57) ABSTRACT

Monitoring an object includes initially detecting motion of the object using at least one of a plurality of sensors disposed at different locations throughout a property, estimating a risk level associated with the object, continuously monitoring the object in response to the object being greater than a predetermined size and the risk level exceeding a first predetermined threshold in a first predetermined amount of time, and alerting a user in response to the object being continuously monitored and the risk level increasing to a second predetermined threshold within a second predetermined amount of time. Monitoring an object may also include halting monitoring of the object in response to the object leaving the property and/or the risk level being less than the first predetermined threshold for longer than the first predetermined amount of time. At least one of the sensor units may have a column portion that includes a vibration sensor.

40 Claims, 5 Drawing Sheets

DETECTING AND IDENTIFYING ACTIVITIES AND EVENTS WITHIN A PROPERTY'S SECURITY PERIMETER USING A CONFIGURABLE NETWORK OF VIBRATION AND MOTION SENSORS

CROSS-REFERENCE TO RELATED APPLICATIONS

This application is a continuation-in-part of U.S. patent application Ser. No. 15/895,606 filed on Feb. 13, 2018 and entitled SECURITY SYSTEM WITH DISTRIBUTED SENSOR UNITS AND AUTONOMOUS CAMERA VEHICLE and claims priority to U.S. Prov. App. No. 62/474,274, filed on Mar. 21, 2017, and entitled "DETECTING AND IDENTIFYING ACTIVITIES AND EVENTS WITHIN A PROPERTY'S SECURITY PERIMETER USING A CONFIGURABLE NETWORK OF VIBRATION AND MOTION SENSORS", both of which are incorporated herein by reference.

TECHNICAL FIELD

This application is directed to the field of hardware and software design of residential security systems, and more particularly to residential security systems with distributed and configurable sensor units using vibration and motion sensors.

BACKGROUND OF THE INVENTION

The market for home security systems is growing at accelerated pace, driven by increased concerns about general and residential security; this market represents an important part of an overlap of two broader markets, namely, all residential and business electronic security systems, and home automation. By 2020, the global market for electronic security systems is expected to reach $80 billion, while market size for home security systems is projected to increase by approximately nine percent per year from less than $30 billion in 2015 to reach $47.5 billion in 2020. Some analysts forecast that the size of the home security solutions market alone will reach $74.3 billion by 2025. North America represents the largest part of the market. Key players in the electronic security system products and services measured by numbers of installed units in the United States are ADT, Monitronics International, Vivint Inc., Tyco Integrated Security, and Vector Security Inc., with combined 9.5 million units installed. ADT is by far the largest vendor with over six million installed units.

Home security vendors offer a broad range of products and solutions for electronic security systems and services, aimed at various types of dwellings, such as tower blocks, regular apartment blocks, condominiums, and private homes. Home security product offerings tracked by some market analytics firms are segmented into electronic locks, sensors, cameras, panic buttons, fire sprinklers & extinguishers, and alarms, while security solutions include medical alert systems, intruder alarm systems, access control & management systems, intercom systems, video surveillance systems, fire protection systems, and integrated systems.

Differentiated assessments of market size for various residential security products are based on property distribution by categories. With approximately 76 millions of free-standing, single family homes in the US, where almost 56 millions of those family homes are residing in lightly populated areas, outside of city centers and dense urban environments (US Census data), only 30% of those homes currently have any kind of a home security system. While this number exceeds by almost two times the percentage of security system present in all US homes (15-17%, according to recent statistics), it shows nevertheless a high unsatisfied demand in advanced home security systems.

Notwithstanding significant progress in developing home security systems and services, current product offerings have significant flaws, especially for free-standing family homes. Existing home security systems are predominantly designed as home invasion sensors and solutions; they do not protect the rest of the property or its external perimeter and do not provide any kind of preventive tracking of potential intruders.

The core design of home security systems has not advanced in several decades. For example, magnetic entry sensors paired with a control unit connected to a landline have served as the basic design since the early 1970s, and even with the use of wireless sensors and cellular connections, contemporary systems continue to utilize the same system design and principles. The setup of a CCTV based home surveillance system still requires expensive installation, extensive wiring and obtrusive mounting of cameras, which are customarily mounted on the house that the cameras are trying to protect, resulting in less than optimal observation angles. Moreover, the experience using a typical home security system is cumbersome.

Accordingly, it is desirable to create a home security system that benefits from advances in sensor technology, protects an expanded security perimeter, provides preventive tracking of potential intruders, takes advantage of wireless and mobile solutions, and provides a privacy-conscious solution.

SUMMARY OF THE INVENTION

According to the system described herein, monitoring an object includes initially detecting motion of the object using at least one of a plurality of sensors disposed at different locations throughout a property, estimating a risk level associated with the object, continuously monitoring the object in response to the object being greater than a predetermined size and the risk level exceeding a first predetermined threshold in a first predetermined amount of time, and alerting a user in response to the object being continuously monitored and the risk level increasing to a second predetermined threshold within a second predetermined amount of time. Monitoring an object may also include halting monitoring of the object in response to the object leaving the property and/or the risk level being less than the first predetermined threshold for longer than the first predetermined amount of time. The risk level may be based on object size and category, motion and vibration patterns, object velocity, object proximity to important parts of the property, and/or composite object behavior. The object category may include animal, human, or vehicle. Motion and vibration patterns may be matched to patterns of a lurking raccoon, a lurking deer, a skunk moving through shrubs, a human walking on the property, a car passing by or entering a driveway, a car stopping nearby, and/or a car door being opened or closed. Composite object behavior may include a human approaching a front door after a car door has opened and closed in proximity to the property. Alerting the user may include displaying information in a mobile application on a mobile device of the user. Following alerting the user, an autonomous camera vehicle may be dispatched to inspect a corresponding location of potential intrusion or other harmful situations. Following alerting the user, the mobile application may prompt the user to authorize one or more of: switching on lights, activating embedded animal repellers in sensor units, or contacting authorities. Each of the sensor units may have a head portion that includes a plurality of motion sensors. Different ones of the motion sensors may be arranged at different vertical angles to capture and estimate heights of objects. The motion sensors may be arranged circularly at different angles to a horizontal plane or spherically, with intersecting tracking areas. The motion sensors may be arranged in a portion of a circle at different angles to a horizontal plane or spherically, with intersecting tracking areas sensors and a remaining portion of the circle represents angular dead zones. The angular dead zones may correspond to areas outside the property and the portion of the circle corresponds to areas inside the property. At least one of the sensor units may have a column portion that includes a vibration sensor. Monitoring an object may also include determining if the vibration sensor is needed to identify the object and activating the vibration sensor in response to the vibration sensor being needed. Following activating the vibration sensor, a vibration profile of the object is determined and compared with stored vibration profiles of known objects. At least one of the sensor units may have a spike based mounting module for installing the sensor unit in soil. The sensor units may communicate wirelessly with the central station. The central station may perform at least some risk assessment.

According further to the system described herein, a non-transitory computer-readable medium contains software that monitors an object. The software includes executable code that initially detects motion of the object using at least one of a plurality of sensors disposed at different locations throughout a property, executable code that estimates a risk level associated with the object, executable code that continuously monitors the object in response to the object being greater than a pre-determined size and the risk level exceeding a first predetermined threshold in a first predetermined amount of time, and executable code that alerts a user in response to the object being continuously monitored and the risk level increasing to a second predetermined threshold within a second predetermined amount of time. The software may also include executable code that halts monitoring of the object in response to the object leaving the property and/or the risk level being less than the first predetermined threshold for longer than the first predetermined amount of time. The risk level may be based on object size and category, motion and vibration patterns, object velocity, object proximity to important parts of the property, and/or composite object behavior. The object category may include animal, human, or vehicle. Motion and vibration patterns may be matched to patterns of a lurking raccoon, a lurking deer, a skunk moving through shrubs, a human walking on the property, a car passing by or entering a driveway, a car stopping nearby, and/or a car door being opened or closed. Composite object behavior may include a human approaching a front door after a car door has opened and closed in proximity to the property. Alerting the user may include displaying information in a mobile application on a mobile device of the user. Following alerting the user, an autonomous camera vehicle may be dispatched to inspect a corresponding location of potential intrusion or other harmful situations. Following alerting the user, the mobile application may prompt the user to authorize one or more of: switching on lights, activating embedded animal repellers in sensor units, or contacting authorities. Each of the sensor units may have a head portion that includes a plurality of motion sensors. Different ones of the motion sensors may be arranged at different vertical angles to capture and estimate heights of objects. The motion sensors may be arranged circularly at different angles to a horizontal plane or spherically, with intersecting tracking areas. The motion sensors may be arranged in a portion of a circle at different angles to a horizontal plane or spherically, with intersecting tracking areas sensors and a remaining portion of the circle represents angular dead zones. The angular dead zones may correspond to areas outside the property and the portion of the circle corresponds to areas inside the property. At least one of the sensor units may have a column portion that includes a vibration sensor. The software may also include executable code that determines if the vibration sensor is needed to identify the object and executable code that activates the vibration sensor in response to the vibration sensor being needed. Following activating the vibration sensor, a vibration profile of the object is determined and compared with stored vibration profiles of known objects. At least one of the sensor units may have a spike based mounting module for installing the sensor unit in soil. The sensor units may communicate wirelessly with the central station. The central station may perform at least some risk assessment.

The proposed system includes a network of sensor units installed on a property, constantly monitoring a space within a security perimeter defined by sensor unit placement and wirelessly communicating with a central station, where the sensor units and the central station are jointly capable of detection, tracking and categorization of extraordinary situations and potential intruders on the property based on risk assessment during tracking of each detected object. The central station may transfer events to a web application (e.g., on a computer) or to a mobile application on a mobile device of an owner/user, and, upon identification of object behavior with an alarming risk level, may alert the owner/user and suggest various actions to address the situation. Sensor units may have motion sensors arranged circularly at different angles to the horizontal plane or spherically, with intersecting tracking areas for better angular resolution and identification of object size, shape and velocity.

A spatially distributed network of sensor units allows the proposed system to focus on perimeter and property security, as opposed to traditional home invasion sensors, such as door and window sensors.

Each sensor unit may include (i) a head module with an array of motion sensors (plus a processor module for local data processing of measurements captured by sensors, a communications module for wireless data exchange with a central station and other optional components such as an array of LED lights); (ii) a column module, enclosing vibration sensor(s) at the ground level and containing other necessary parts, such as a battery pack or an ultra-sound animal repeller; and (iii) a mounting module for installing the sensor unit on various surfaces or attaching the sensor unit to different structures.

Circular disposition of motion sensors in the head module puts sensors in the vertices of areas being monitored, so that tracking areas for adjacent polygons covered by different sensors have a significant intersection. Additionally, tracking areas of motion sensors may be directed at different angles with respect to a horizontal plane, thus expanding vertical range of the tracking system and allowing for object height estimation. For example, half of the motion sensors may have tracking areas looking upward at a certain angle, while an other half may have tracking areas looking downward at the same angle.

In one experimental example, tracking areas of PIR sensors had a horizontal coverage distance of 15-30 ft. with a horizontal coverage angle of 38 degrees and a vertical coverage angle of 22 degrees. The head module included a circular array of 20 motion sensors at an angular distance of 18 degrees between adjacent sensors, where half of sensors were oriented upwards at an angle of 11 degrees and another half of sensors were oriented downwards at an angle of 11 degrees.

When an object appears in a tracking area of one or more motion sensors of a particular sensor unit, the object may be registered by several motion sensors in the array, which may allow an instant estimate of object size and shape. When the object is moving, a set of motion sensors that register a position of the object within a tracking area of each capturing sensor changes, allowing calculation of an object motion vector (angular speed and direction) based on the data that is obtained.

Circular motion sensors may cover only a portion of a circle and may have angular dead zones. Thus, near angles on a boundary of a property map, sensor units may have circular motion sensors excluded from an outer side so that the corresponding combined tracking area from the sensor array detects objects inside the property. Similarly, one or more sensor units installed at a junction of a street and a driveway within the property may have only partial coverage of the objects in the street. Additionally, circular motion sensors may be dynamically configured to adapt to certain dynamic situations, such as a public event (e.g., a fair) adjacent to the property.

In addition to a size, shape, motion and velocity detection abilities, multiple sensor units with known positions on the property may triangulate an object and assess absolute coordinates of the object within the property. In general, configuration of a network of sensor units may allow positional tracking of objects in any significant portion of the property. Main points of interest (POIs) on the property (e.g., front door, back door, front yard, a power station located on the property, etc.) may be named (labeled) during configuration of the system, and coordinates in the map may be associated with closest POIs. For example, a monitoring or alarm record displayed in the mobile application may specify that an object is approaching a kitchen window.

The system may compare detected motion patterns with previously-stored known motion patterns, associated with various object categories, such as waving tree branches, sliding leaves, animals lurking through the property or targeting certain parts of the property, human walk, etc. In some instances, the patterns may have trainable features and parameters allowing to improve motion and object recognition over time. In addition to motion sensors, each or some sensor units may include a vibration sensor near a bottom portion of the column for the sensor unit. The system may be supplied with vibration profiles for various processes, such as human steps, car/garage/house door opened/closed, moving vehicle, etc. aimed at recognizing objects and activities occurring on the property. Vibration sensors may be permanently active or, in an energy saving mode or implementation of the system, the vibration sensors may be activated by the system after motion sensors detects an object and the system decides to track the object.

A total height of a sensor unit may allow motion sensors enclosed in the head module to distinguish objects by relative heights of the objects within a vertical sensitivity area. In an embodiment, a full height of an installed sensor unit above the surface is about 18".

A central station may contain a main processing unit responsible for a majority of data processing and may contain a communication unit, which maintains connections with the sensor units and with mobile applications for mobile device-based visualization and with software for control and system management. The central station may simultaneously support multiple communications protocols and methods, such as a dedicated RF connection with sensor units and Wi-Fi or LAN connection with home automation systems and owner mobile devices when owner(s)/user(s) are on the property.

System functioning and interaction between sensor units, central station and the owner's mobile device(s) may be described as follows:

1. After installation, configuration and initialization, sensor units constantly monitor a security perimeter of a property.
2. Once sensor units detect an unusual activity, normally associated with an object or multiple objects within tracking zones of the sensor units, the sensor units coordinate with a central unit to monitor the object(s) and the associated activity until the activity is either diminished sufficiently or is upgraded to an alert status with potentially threatening consequences, such as a potential intrusion. Subsequently, an owner/user may be alerted, offered additional actions to mitigate the danger, and the system may manage and fulfill such actions, subject to approval of the owner/user.

a. A dynamic status of each new object and activity detected by sensor units is based on risk assessment, which may take into consideration various factors from the following list (without limitation):
b. Object size and category, for example, animal, human, vehicle.
c. Motion and vibration patterns, for example, a lurking raccoon, a lurking deer, a skunk moving through shrubs, human walking on the property, car passing by or entering a driveway, car stopping nearby, car door opened/closed, etc.
d. Object velocity.
e. Object proximity to important parts of property, such as the above-mentioned POIs. The system may have different weights assigned to the same values of proximity of a tracked object to different POIs for the risk calculation routine. Alternatively, each POI may be assigned a risk level corresponding to continued monitoring and alerts.
f. Composite object behavior, for example, an object identified as a human approaching a front door after a car door has opened and closed in proximity to the property.

3. Risk assessment may be conducted by the central station based on object/activity tracking data received from sensor unit(s). The system may support various sets of risk levels and corresponding decision procedures. For example, the system may maintain two risk levels: a continuous monitoring level and an alert level. The system may implement the following object and activity management:

a. If a new activity does not reach a continuous monitoring level within a given amount of time or associated object(s) disappear from a tracking zone within the given amount of time, the activity and the object are dismissed by the system. Examples may include a passing-by car, a shrub movement identified as waving due to wind, etc.

b. Once a new activity reaches the continuous monitoring level, the activity and associated object(s) are permanently tracked until the object(s) either disappear from the property and/or the associated activity subsides. For example, if an object is lurking around the property, it is monitored until it leaves the property.

c. When an alert level is reached, the system communicates the situation to an owner/user; by for example, displaying information in a mobile application on a mobile device of the owner/user. Subsequent actions of the system may include dispatching an autonomous camera vehicle to inspect the corresponding location of potential intrusion or other harmful situations, taking automatic or owner/user approved actions, such as switching on lights or embedded animal repellers in sensor units, contacting authorities, etc.

4. The owner/user may monitor system functioning in various ways. For example, the log of tracking events and the progress of tracking of all activities by the system may appear in a background in the mobile application associated with the system and running on a smartphone of the owner/user or on another mobile device, a desktop computer, a dedicated screen, etc. Once an alert level for a certain activity is present, the system may display the alert as a foreground notification, with associated recommendations and action buttons, inviting the owner/user to approve a suggested course of actions, to select an action from a list, to dismiss the alert, etc.

BRIEF DESCRIPTION OF THE DRAWINGS

Embodiments of the system described herein will now be explained in more detail in accordance with the figures of the drawings, which are briefly described as follows.

DETAILED DESCRIPTION OF VARIOUS EMBODIMENTS

The system described herein provides detection, tracking and categorization of extraordinary situations and potential intruders on a property based on risk assessment during tracking of each detected object via a network of sensor units installed on the property, which are constantly monitoring a space within a security perimeter of the sensors and wirelessly communicating with a central station for information exchange, decision making and potential wireless delivery of warnings to a mobile or other application used by a property owner and/or a user of the system.

Figure 1A:
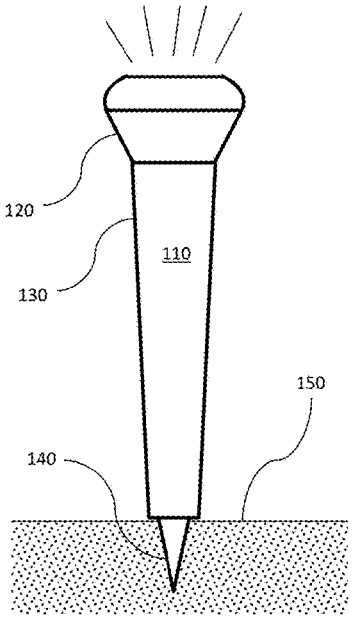
FIGS. 1A-1C are schematic illustrations of assembly of a sensor unit with circular and spherical arrangement of motion sensors, according to an embodiment of the system described herein.
Figure 1B:
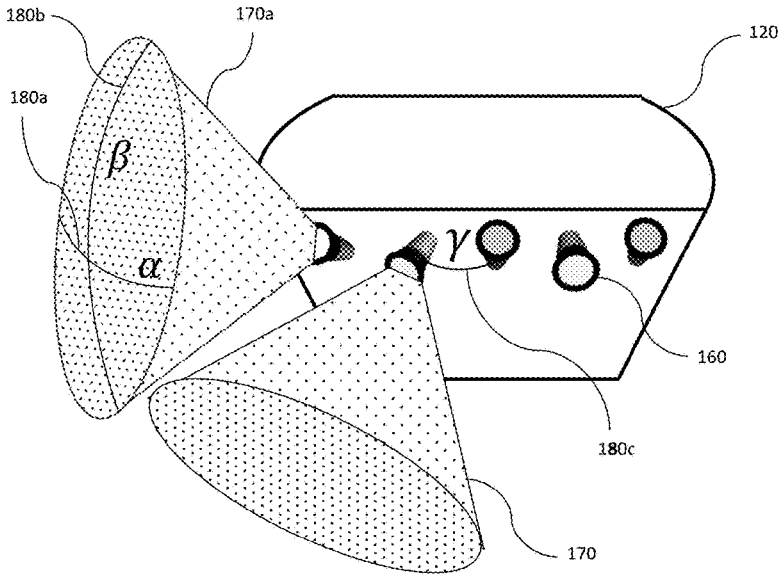
Figure 1C:
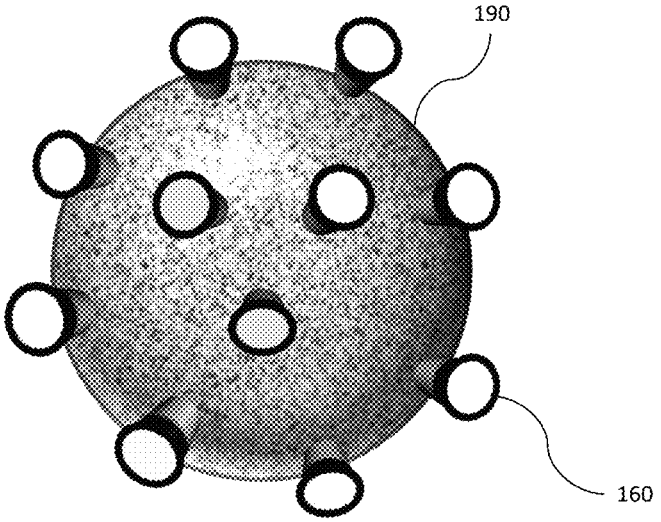

FIGS. 1A-1C are schematic illustrations of assembly of a sensor unit with circular and spherical arrangement of motion sensors.

FIG. 1A is a schematic illustration of an assembled sensor unit 110, which may include three parts: a head module 120, a column module 130 and a mounting module 140 (here shown as a ground installation spike for mounting a sensor unit in soil 150).

FIG. 1B schematically illustrates the head module 120 in more detail with circular arrangement of motion sensors 160. Tracking areas of the motions sensors 160 may be directed at different angles with respect to a horizontal plane, thus expanding vertical reach of the tracking system and allowing for object height estimation, as explained elsewhere herein. For example, a tracking area 170 looks downward, while an adjacent tracking area 170*a* is looking upward, while each of the tracking areas 170, 170*a* has a horizontal tracking angle 180*a* ($\alpha$) and a vertical tracking angle 180*b* ($\beta$) and there is an angle 180*c* ($\gamma$) between adjacent ones of the sensors 160; for example, if the angle 180*c* between every pair of adjacent ones of the sensors 160 is 18° then an array of twenty sensors covers a full 360-degree tracking area.

FIG. 1C shows a spherical arrangement of the motion sensors 160 on a surface of a sphere 190; such an arrangement allows the sensors 160 to track higher and lower objects than the arrangement shown in FIG. 1B. The arrangement of FIG. 1C also allows tracking objects approaching the property from above (such as birds or unknown aerial drones).

Figure 2:
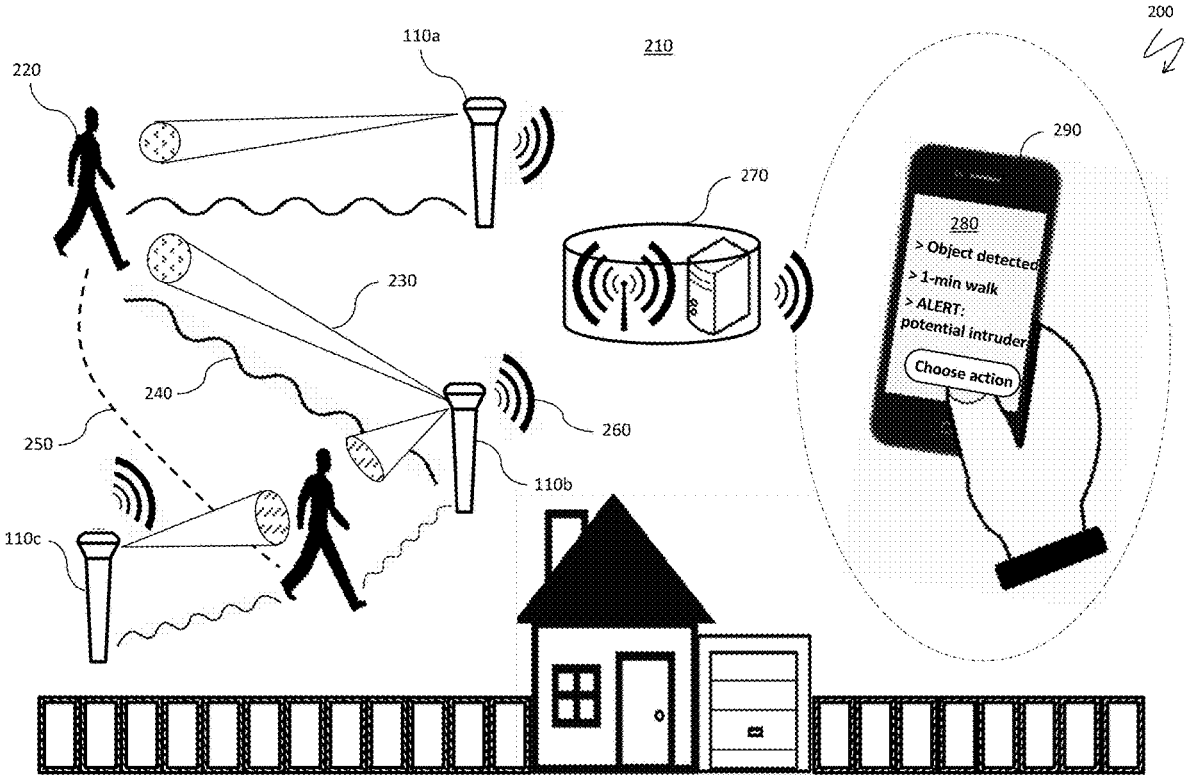
FIG. 2 is a schematic illustration of detection and monitoring of a potential intrusion, according to an embodiment of the system described herein.

FIG. 2 is a schematic illustration 200 of detection and monitoring of a potential intrusion. The system may be installed on a property 210 and may include a network of sensor units 110*a*, 110*b*, 110*c* distributed across the property 210. Once an unknown object 220 is detected by motion sensors 230 and vibration sensors 240, the object 220 may be triangulated by closest ones of the sensor units 110*a*-110*c*. In FIG. 2, the object 220 is initially triangulated by the sensor units 110*a*, 110*b*, and, as the object 220 moves along a trajectory 250, tracking the object 220 may switch from the sensor unit 110*a* to the sensor unit 110*c*. The sensor units 110*a*-110*c* attempt to identify the object 220 and may exchange information 260 about the object 220 with a central station 270 to facilitate identification and make decisions on a possible course of actions. In FIG. 2, the system identifies the object 220, after prolonged tracking, as a potential intruder and sends an alert to a mobile application 280 running on a smartphone 290 of the property owner or other person in charge of property security (user).

Figure 3:
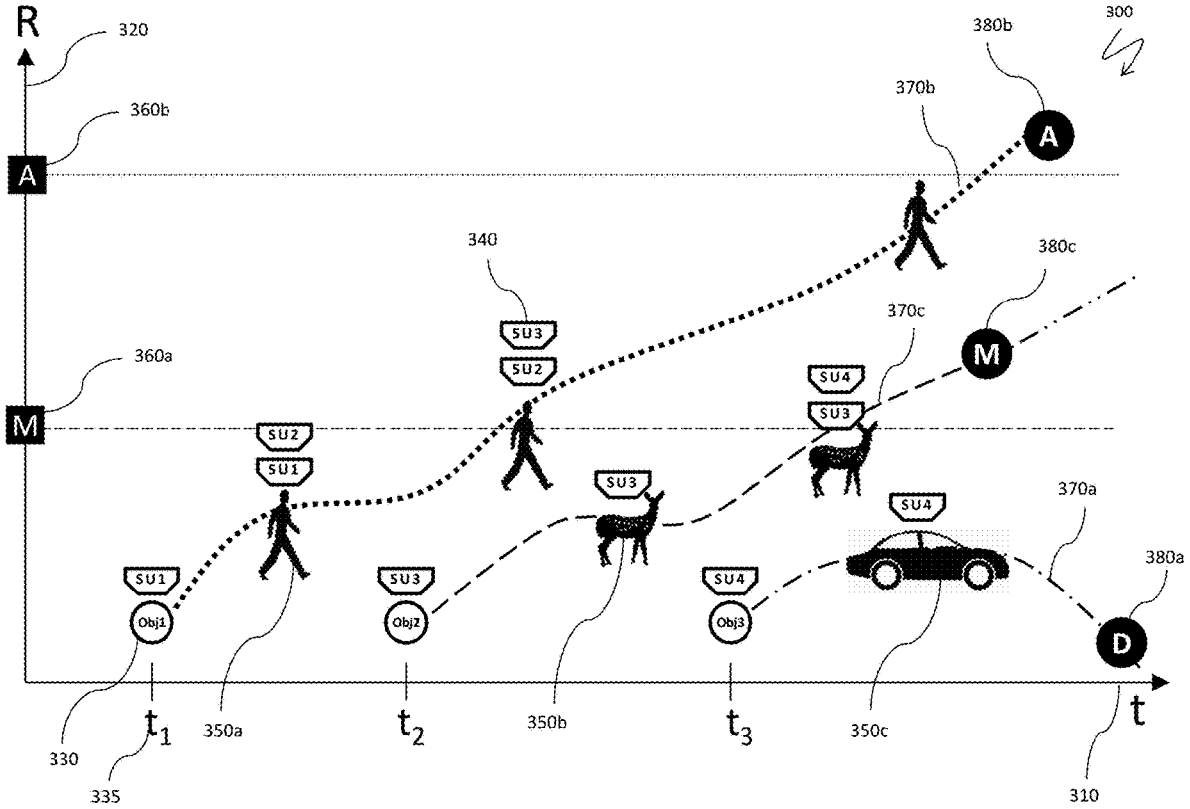
FIG. 3 is a schematic illustration of process and event tracking in the system, according to an embodiment of the system described herein.

FIG. 3 is a schematic illustration 300 of process and event tracking in the system. Two-dimensional graphs of different risk profiles are built over a timeline 310 and show dynamics of risk levels on a scale 320 for each object 330 detected on the property at a starting time 335 of a tracking period and monitored by one or more sensor units 340, as explained elsewhere herein. The sensor units 340 may attempt to identify each object and/or exchange data with a central station (see, for example, the central station 270 in FIG. 2) for data interpretation. In FIG. 3, three types of objects are detected on or near the property at different times: a person 350*a*, an animal 350*b* and a car 350*c*; factors contributing to data interpretation and criteria for object classification are explained elsewhere herein.

The system tracks each object for a predetermined time to determine whether a risk profile of each object crosses either a monitoring level 360*a* or an alert level 360*b*. Based on object behavior and risk profile of each object, the system makes further decisions. Thus, a risk profile 370*a* of the car 350*c* that is passing by does not approach even a monitoring level 360*a* and the system makes a decision 380*a* to drop object tracking. A risk profile 370*b* of a person 350*a* crosses both the monitoring level 360*a* and the alert level 360*b*, so the system continues to monitor the object for a predefined time specific for the alert risk level and then makes a decision 380*b* to send an alert to the property owner or other user (see also FIG. 2 for the analysis of a similar situation). As to the animal 350*b*, a risk profile 370*c* of the animal 350*b* reaches the monitoring level 360*a* but does not raise to the alert level 360*b* and the system makes a decision 380*c* to continue object monitoring for an additional time period, as illustrated by a graph curve of the risk profile 370*c*, continued beyond a decision point 380*c*.

Figure 4:
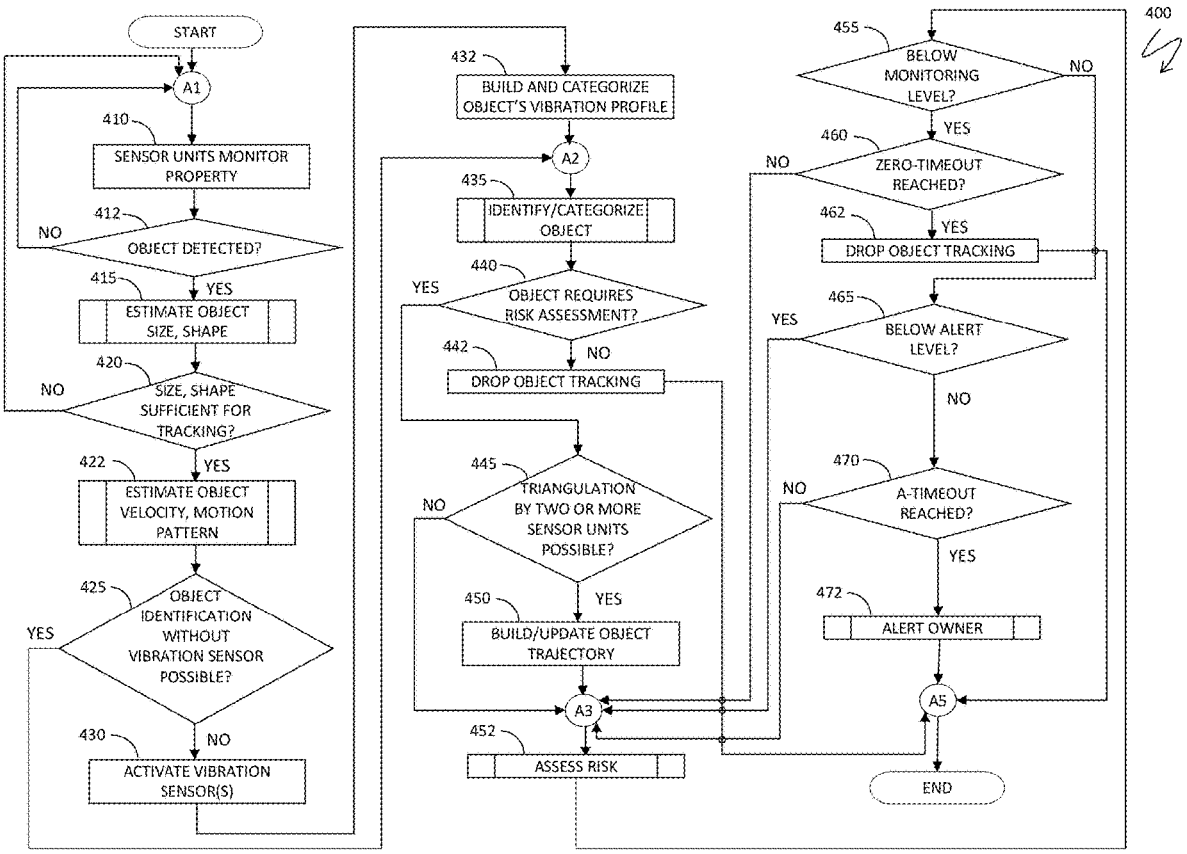
FIG. 4 is a system flow diagram illustrating system functioning in connection with detection, tracking and categorization of objects and extraordinary situations, according to an embodiment of the system described herein.

Referring to FIG. 4, a system flow diagram 400 illustrates processing in connection with detection, tracking and categorization of objects and extraordinary situations. Processing begins at a step 410, where a network of installed sensor units is continuously monitoring a property. Note that initially only motion sensors of the sensor units may be activated. After the step 410, processing proceeds to a test step 412, where it is determined whether a new object has been detected by one or more of the sensor units. If not, processing proceeds back to the step 410; otherwise, processing proceeds to a step 415, where object size and shape are estimated, as explained elsewhere herein. After the step 415, processing proceeds to a test step 420, where it is determined whether the size and shape of the new object qualify for being tracked by the system. If not, processing proceeds back to the step 410; otherwise, processing proceeds to a step 422, where the system estimates object velocity and motion patterns, as described elsewhere herein. Note that identifying velocity and motion patterns may require communications and data exchange between sensor unit(s) and/or the central station.

After the step 422, processing proceeds to a test step 425, where it is determined if object identification without vibration sensors is possible. If not, processing proceeds to a step 430, where vibration sensor(s) is (are) activated for one or multiple sensor units that are currently sensing the new object with motion sensors. After the step 430, processing proceeds to a step 432, where the system builds and categorizes a vibration profile of the object (vibration sensors were previously activated at the step 430). After the step 432, processing proceeds to a step 435, where the system identifies and categorizes the new object based on previously collected information, such as size, shape, motion profile and (optionally) vibration profile, as explained elsewhere herein. Note that the step 435 may be independently reached from the test step 425. After the step 435, processing proceeds to a test step 440, where it is determined whether the identified and categorized object requires risk assessment. If not, processing proceeds to a step 442 where the system drops object tracking; after the step 442, processing is complete. Otherwise, processing proceeds to a test step 445, where it is determined whether triangulation of the new object by two or more sensor units is possible. If so, processing proceeds to a step 450 where the system builds or updates object trajectory using data from multiple sensor units. After the step 450, processing proceeds to a step 452 where the system assesses a risk presented by the new object. Note that the step 452 may be independently reached from the test step 445, if it triangulation of the new object by multiple sensor units is not possible (in this case, risk assessment is done on the basis of tracking with only one sensor unit).

After the step 452, processing proceeds to a test step 455, where it is determined whether the just assessed risk value for the new object is below the monitoring level. If so, processing proceeds to a test step 460, where it is determined whether the tracking time interval has reached a pre-determined value—a condition for dropping object tracking in case the activity/object didn't reach the monitoring level of risk, as explained elsewhere herein (see, for example, FIG. 3 and the accompanying text). If the tracking time interval reaches the pre-determined value, processing proceeds to a step 462 where the system drops object tracking; after the step 462, processing is complete. If it is determined at the test step 460 that the pre-determined time amount has not been reached yet, processing proceeds to the step 452 for continued risk assessment. If it is determined at the test step 455 that the assessed risk value is above or equal to the monitoring level, processing proceeds to a test step 465, where it is determined whether the most recently assessed risk level at the step 452 is below the alert level (see, for example, FIG. 3 and the accompanying text). If so, processing proceeds to the step 452 for continued risk assessment. Otherwise, processing proceeds to a test step 470, where it is determined whether an A-timeout (alert timeout) has been reached. The A-timeout is a sufficiently long time interval when the assessed object risk stays at or above the alert level, justifying the decision to send an alert. If the A-timeout has been reached, processing proceeds to a step 472 where the system alerts the owner/user; after the step 472, processing is complete. If it is determined at the test step 470 that the A-timeout has not been reached, processing proceeds back to the step 452 for the continued risk assessment.

Various embodiments discussed herein may be combined with each other in appropriate combinations in connection with the system described herein. Additionally, in some instances, the order of steps in the flowcharts, flow diagrams and/or described flow processing may be modified, where appropriate. Subsequently, system configurations, tracking mechanisms and decisions may vary from the illustrations presented herein. Further, various aspects of the system described herein may be implemented using software, hardware, a combination of software and hardware and/or other computer-implemented modules or devices having the described features and performing the described functions. Smartphones functioning as devices running mobile system application(s) for property owners may include software that is pre-loaded with the device, installed from an app store, installed from a desktop (after possibly being pre-loaded thereon), installed from media such as a CD, DVD, etc., and/or downloaded from a Web site. Such smartphones may use operating system(s) selected from the group consisting of: iOS, Android OS, Windows Phone OS, Blackberry OS and mobile versions of Linux OS.

Software implementations of the system described herein may include executable code that is stored in a computer readable medium and executed by one or more processors. The computer readable medium may be non-transitory and include a computer hard drive, ROM, RAM, flash memory, portable computer storage media such as a CD-ROM, a DVD-ROM, a flash drive, an SD card and/or other drive with, for example, a universal serial bus (USB) interface, and/or any other appropriate tangible or non-transitory computer readable medium or computer memory on which executable code may be stored and executed by a processor. The software may be bundled (pre-loaded), installed from an app store or downloaded from a location of a network operator. The system described herein may be used in connection with any appropriate operating system.

Other embodiments of the invention will be apparent to those skilled in the art from a consideration of the specification or practice of the invention disclosed herein. It is intended that the specification and examples be considered as exemplary only, with the true scope and spirit of the invention being indicated by the following claims.

What is claimed is:

1. A method of monitoring an object, comprising:

initially detecting motion of the object using at least one of a plurality of sensors disposed at different locations throughout a property;

estimating a numeric risk level associated with the object, wherein the numeric risk level varies according to a risk profile associated with the object and an amount of time since the object has been detected;

continuously monitoring the object in response to the object being greater than a pre-determined size and the numeric risk level exceeding a first predetermined threshold in a first predetermined amount of time; and alerting a user in response to the object being continuously monitored and the numeric risk level increasing to a second predetermined threshold within a second predetermined amount of time, wherein the second predetermined threshold is different from the first predetermined threshold.

2. A method, according to claim 1, further comprising:

halting monitoring of the object in response to at least one of: the object leaving the property or the numeric risk level being less than the first predetermined threshold for longer than the first predetermined amount of time.

3. A method, according to claim 1, wherein the numeric risk level is based on at least one of: object size and category, motion and vibration patterns, object velocity, object proximity to important parts of the property, and composite object behavior.

4. A method, according to claim 3, wherein the object category includes one of: animal, human, or vehicle.

5. A method, according to claim 3, wherein motion and vibration patterns are matched to patterns of at least one of: a lurking raccoon, a lurking deer, a skunk moving through shrubs, a human walking on the property, a car passing by or entering a driveway, a car stopping nearby, or a car door being opened or closed.

6. A method, according to claim 3, wherein composite object behavior includes a human approaching a front door after a car door has opened and closed in proximity to the property.

7. A method, according to claim 1, wherein alerting the user includes displaying information in a mobile application on a mobile device of the user.

8. A method, according to claim 7, wherein following alerting the user, an autonomous camera vehicle is dispatched to inspect a corresponding location of potential intrusion or other harmful situations.

9. A method, according to claim 7, wherein following alerting the user, the mobile application prompts the user to authorize one or more of: switching on lights, activating embedded animal repellers in sensor units, or contacting authorities.

10. A method, according to claim 1, wherein each of the sensor units has a head portion that includes a plurality of motion sensors.

11. A method, according to claim 10, wherein different ones of the motion sensors are arranged at different vertical angles to capture and estimate heights of objects.

12. A method, according to claim 10, wherein the motion sensors are arranged circularly at different angles to a horizontal plane or spherically, with intersecting tracking areas.

13. A method, according to claim 10, wherein the motion sensors are arranged in a portion of a circle at different angles to a horizontal plane or spherically, with intersecting tracking areas sensors and a remaining portion of the circle represents angular dead zones.

14. A method, according to claim 13, wherein the angular dead zones correspond to areas outside the property and the portion of the circle corresponds to areas inside the property.

15. A method, according to claim 1, wherein at least one of the sensor units has a column portion that includes a vibration sensor.

16. A method, according to claim 15, further comprising:

determining if the vibration sensor is needed to identify the object; and activating the vibration sensor in response to the vibration sensor being needed.

17. A method, according to claim 16, wherein following activating the vibration sensor, a vibration profile of the object is determined and compared with stored vibration profiles of known objects.

18. A method, according to claim 1, wherein at least one of the sensor units has a spike based mounting module for installing the sensor unit in soil.

19. A method, according to claim 1, wherein the sensor units communicate wirelessly with the central station.

20. A method, according to claim 19, wherein the central station performs at least some risk assessment.

21. A non-transitory computer-readable medium containing software that monitors an object, the software comprising:

executable code that initially detects motion of the object using at least one of a plurality of sensors disposed at different locations throughout a property;

executable code that estimates a numeric risk level associated with the object, wherein the numeric risk level varies according to a risk profile associated with the object and an amount of time since the object has been detected;

executable code that continuously monitors the object in response to the object being greater than a pre-determined size and the numeric risk level exceeding a first predetermined threshold in a first predetermined amount of time; and executable code that alerts a user in response to the object being continuously monitored and the numeric risk level increasing to a second predetermined threshold within a second predetermined amount of time, wherein the second predetermined threshold is different from the first predetermined threshold.

22. A non-transitory computer-readable medium, according to claim 21, further comprising:

executable code that halts monitoring of the object in response to at least one of: the object leaving the property or the numeric risk level being less than the first predetermined threshold for longer than the first predetermined amount of time.

23. A non-transitory computer-readable medium, according to claim 21, wherein the numeric risk level is based on at least one of: object size and category, motion and vibration patterns, object velocity, object proximity to important parts of the property, and composite object behavior.

24. A non-transitory computer-readable medium, according to claim 23, wherein the object category includes one of: animal, human, or vehicle.

25. A non-transitory computer-readable medium, according to claim 23, wherein motion and vibration patterns are matched to patterns of at least one of: a lurking raccoon, a lurking deer, a skunk moving through shrubs, a human walking on the property, a car passing by or entering a driveway, a car stopping nearby, or a car door being opened or closed.

26. A non-transitory computer-readable medium, according to claim 23, wherein composite object behavior includes a human approaching a front door after a car door has opened and closed in proximity to the property.

27. A non-transitory computer-readable medium, according to claim 21, wherein alerting the user includes displaying information in a mobile application on a mobile device of the user.

28. A non-transitory computer-readable medium, according to claim 27, wherein following alerting the user, an autonomous camera vehicle is dispatched to inspect a corresponding location of potential intrusion or other harmful situations.

29. A non-transitory computer-readable medium, according to claim 27, wherein following alerting the user, the mobile application prompts the user to authorize one or more of: switching on lights, activating embedded animal repellers in sensor units, or contacting authorities.

30. A non-transitory computer-readable medium, according to claim 21, wherein each of the sensor units has a head portion that includes a plurality of motion sensors.

31. A non-transitory computer-readable medium, according to claim 30, wherein different ones of the motion sensors are arranged at different vertical angles to capture and estimate heights of objects.

32. A non-transitory computer-readable medium, according to claim 30, wherein the motion sensors are arranged circularly at different angles to a horizontal plane or spherically, with intersecting tracking areas.

33. A non-transitory computer-readable medium, according to claim 30, wherein the motion sensors are arranged in a portion of a circle at different angles to a horizontal plane or spherically, with intersecting tracking areas sensors and a remaining portion of the circle represents angular dead zones.

34. A non-transitory computer-readable medium, according to claim 33, wherein the angular dead zones correspond to areas outside the property and the portion of the circle corresponds to areas inside the property.

35. A non-transitory computer-readable medium, according to claim 21, wherein at least one of the sensor units has a column portion that includes a vibration sensor.

36. A non-transitory computer-readable medium, according to claim 35, further comprising:

executable code that determines if the vibration sensor is needed to identify the object; and executable code that activates the vibration sensor in response to the vibration sensor being needed.

37. A non-transitory computer-readable medium, according to claim 36, wherein following activating the vibration sensor, a vibration profile of the object is determined and compared with stored vibration profiles of known objects.

38. A non-transitory computer-readable medium, according to claim 21, wherein at least one of the sensor units has a spike based mounting module for installing the sensor unit in soil.

39. A non-transitory computer-readable medium, according to claim 21, wherein the sensor units communicate wirelessly with the central station.

40. A non-transitory computer-readable medium, according to claim 39, wherein the central station performs at least some risk assessment.

* * * * *